United States Patent [19]

Maruyama et al.

[11] 4,145,677

[45] Mar. 20, 1979

[54] COLOR MISALIGNMENT CORRECTION DEVICE FOR COLOR PICTURE TUBE

[75] Inventors: Koichi Maruyama, Chiba; Kuniharu Osakabe; Satoshi Kawanishi, both of Mobara, all of Japan

[73] Assignee: Hitachi, Ltd., Japan

[21] Appl. No.: 803,387

[22] Filed: Jun. 3, 1977

[30] Foreign Application Priority Data

Aug. 20, 1976 [JP] Japan ..... 51-99249

[51] Int. Cl.[2] ..... H01F 1/00

[52] U.S. Cl. ..... 335/212; 335/210

[58] Field of Search ..... 335/210, 212

[56] References Cited

U.S. PATENT DOCUMENTS

| | | | |
|---|---|---|---|
| 3,899,710 | 8/1975 | Machida et al. | 335/212 |
| 3,906,418 | 9/1975 | Doshi et al. | 335/212 |

*Primary Examiner*—George Harris

*Attorney, Agent, or Firm*—Craig & Antonelli

[57] ABSTRACT

A color misalignment correction device for use in a color picture tube, in which at least two magnets are disposed rotatably and adjustably on the outer peripheral surface of the cathode-ray bulb so as to correct an arc-shaped convergence error appearing in a horizontal direction of the phosphor screen due to a mounting error of the electron guns in the color picture tube or due to a mounting error of the deflection coil assembly on the color picture tube.

7 Claims, 12 Drawing Figures

COLOR MISALIGNMENT CORRECTION DEVICE FOR COLOR PICTURE TUBE

This invention relates to a device for correcting color misalignment in a color picture tube, and more particularly to a dynamic convergence device for correcting color misalignment occurring in peripheral portions of reproduced pictures.

Figure 1:
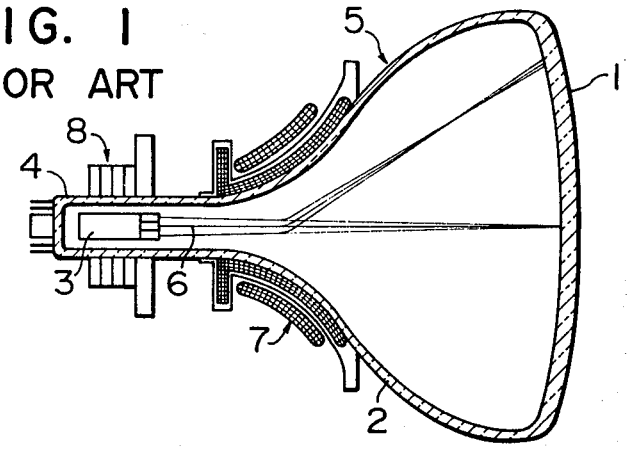
FIG. 1 PRIOR ART

A color picture tube is generally provided in the form of a bulb 5 having a panel portion 1 including a phosphor screen and a shadow mask, a funnel portion 2 analogous to a funnel in shape, and a neck portion 4 accommodating therein three electron guns 3 emitting three electron beams 6, as shown in FIG. 1. The bulb 5 provides a vacuum envelope in which a vacuum atmosphere is maintained. A deflection coil assembly 7 is disposed on the outer peripheral surface of the funnel portion 2 of the bulb 5 for deflecting the three electron beams 6 emitted from the electron guns 3. A magnet assembly 8 is disposed on the outer peripheral surface of the neck portion 4 of the bulb 5, and the intensity and direction of the magnetic field produced by the magnet assembly 8 are suitably varied so as to precisely guide the three electron beams 6 toward the center of deflection.

In the color picture tube having such a construction, the three electron beams 6 emitted from the electron guns 3 are deflected by the deflection coil assembly 7 to impinge against the phosphor screen through the shadow mask (not shown) disposed within the panel portion 1 of the bulb 5 thereby providing emission of three primary colors, red, green and blue. In order to reproduce a picture without color misalignment, the three electron beams 6 must be exactly aligned on the phosphor screen. This electron beam alignment is called convergence. The convergence includes static convergence for attaining alignment of the three electron beams 6 in the central area of the phosphor screen and dynamic convergence for attaining alignment of the three electron beams 6 in the peripheral area of the phosphor screen.

Figure 2A:
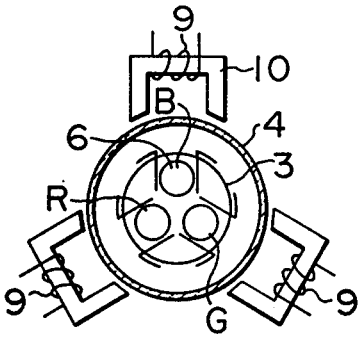
FIG. 2a PRIOR ART
Figure 2B:
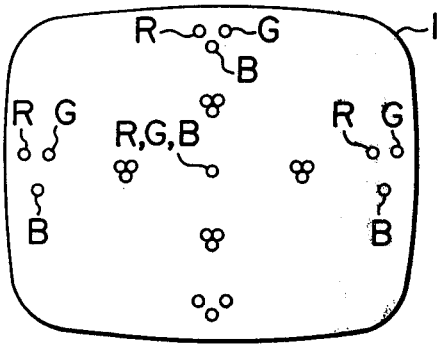
FIG. 2b PRIOR ART

Since the purpose of the static convergence is to attain alignment of the three electron beam 6 arriving at the central area of the phosphor screen, the electron beams 6 are very slightly deflected by the deflection coil assembly 7 in that area. According to conventional designs, the electron guns 3 themselves are mounted in a relation slightly inclined with respect to the axis of the neck portion 4 of the bulb 5 to achieve the desired static convergence. In the known construction shown in FIG. 1, the magnet assembly 8 consisting of permanent magnets is disposed on the outer peripheral surface of the neck portion 4 of the bulb 5 opposite the electron guns 3 in order to correct a static convergence error attributable to, for example, a slight assembling error of the electron guns 3 which occurred during assembling of the color picture tube. In FIG. 1, the intensity of the magnetic field produced by the permanent magnets is suitably varied to adjust the static convergence thereby ensuring concentration of the three electron beams 6 on a single spot. However, the three electron beams 6 deflected by the deflection coil assembly 7 to be directed toward the peripheral area of the phosphor screen are not always concentrated on a single spot in this area, although the three electron beams 6 directed toward the central area of the phosphor screen can be exactly aligned by the magnet assembly 8 provided for the attainment of the static convergence. FIG. 2*a* shows means generally used for correcting such a dynamic convergence error when the color picture tube is of the delta type. Referring to FIG. 2*a*, dynamic convergence coils 9 are disposed around the outer peripheral surface of the neck portion 4 of the bulb 5 to correct such a dynamic convergence error by externally applying a magnetic field to the three electron beams 6 emitted from the electron guns 3. FIG. 2*b* shows a dynamic convergence pattern on the phosphor screen of the delta type color picture tube. It will be seen in FIG. 2*b* that the convergence error is greatest in the peripheral area of the phosphor screen and is gradually reduced toward the central area of the phosphor screen. Known parabolic correction must therefore be made in the panel portion 1 of the bulb 5. For this purpose, it is required to mount the dynamic convergence coils 9 on individual cores 10 disposed around the neck portion 4 of the bulb 5 opposite the electron guns 3 so as to supply parabolic current through the dynamic convergence coils 9. The prior art device shown in FIG. 2*a* further requires a dynamic convergence correction circuit having variable circuit elements for controlling the parabolic current. Thus, complex arrangement has been required heretofore for the attainment of the desired dynamic convergence.

Figure 3A:
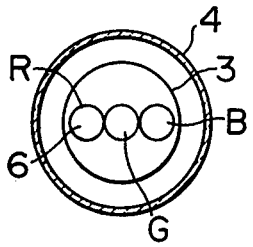
FIG. 3a PRIOR ART
Figure 3B:
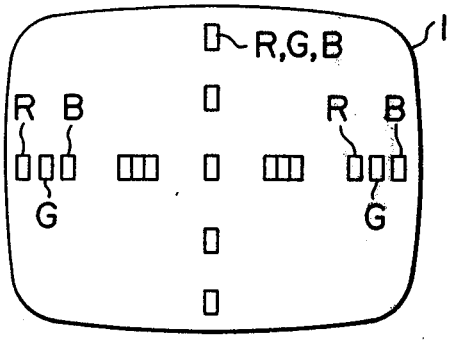
FIG. 3b PRIOR ART

FIG. 3*a* shows means generally used for correcting the dynamic convergence error when the color picture tube is of the in-line type in which the three electron guns 3 are arranged in line in the horizontal direction. FIG. 3*b* shows a dynamic convergence pattern on the phosphor screen of the in-line type color picture tube. It will be seen in FIG. 3*b* that the dynamic convergence error in the vertical direction is less than that in FIG. 2*b*. Consequently, the dynamic convergence correction circuit portion pertaining to the correction of the dynamic convergence error in the vertical direction can be eliminated, and the number of variable circuit elements in the correction circuit can be greatly reduced. Further, the dynamic convergence pattern of the in-line type color picture tube shown in FIG. 3*b* includes a one-dimensional error in the horizontal direction only compared with the two-dimensional error appearing on the convergence pattern of the delta type color picture tube shown in FIG. 2*b*. Such a one-dimensional dynamic convergence error can be easily dealt with by suitably distorting the magnetic field produced by the deflection coil assembly 7 so that, theoretically, the three electron beams 6 can be aligned without the necessity for having the circuit provided especially for carrying out the parabolic correction. Consequently, the dynamic convergence correction circuit portion pertaining to the correction of the dynamic convergence error in the horizontal direction can also be eliminated to obviate completely the necessity for provision of the dynamic convergence correction circuit.

Figure 4A:
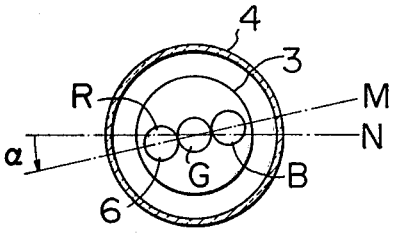
FIG. 4a PRIOR ART

A dynamic convergence error will also result from a mounting error of the electron guns 3 relative to the bulb 5 and also from an assembling error of the deflection coil assembly 7 relative to the bulb 5. Such a dynamic convergence error is corrected by suitably adjusting the relative positions of the electron beams 6 and deflection coil assembly 7 during the stage of mounting the deflection coil assembly 7. However, the whole dynamic convergence pattern resulting from these assembling errors cannot be corrected by adjusting the relative positions of the electron beams 6 and deflection coil assembly 7 in the stage above described. The above fact will be explained with reference to FIGS. 4*a* and 4*b*. In the stage of fixing the electron guns 3 in the predetermined position during assembling, the electron guns 3 may be fixed in a state in which they are rotated and displaced from the horizontal in-line position giving rise to a so-called "twist error", that is, the electron guns 3 may be fixed in a relation angularly displaced by an angle $\alpha$ from the proper position as shown in FIG. 4*a*. Further, the deflecting magnetic field produced by the deflection coil assembly 7 (not shown) may be displaced from the proper direction due to an assembling error of the deflection coil assembly 7 thereby giving rise to rotation or twisting of the three electron beams 6. In such a case, an arc-shaped dynamic convergence error of blue and red results. Although this arc-shaped dynamic convergence error can be corrected by, for example, rotating the deflection coil assembly 7 relative to the three electron beams 6, this rotation results in a disadvantage such as tilting of the picture being reproduced on the phosphor screen. With the increase in the angle of deflection, such a dynamic convergence error resulting from the assembling error becomes extremely marked to such an extent which is not negligible in a color picture tube of large size.

With a view to obviate the aforementioned prior art defects, it is a primary object of the present invention to provide a color picture tube provided with means for satisfactorily correcting an arc-shaped dynamic convergence error appearing horizontally on the phosphor screen due to a mounting error occurring during mounting the electron guns in the color picture tube and also due to a mounting error occurring during mounting the deflection coil assembly on the color picture tube.

The color picture tube according to the present invention which attains the above object is featured by the fact that permanent magnets are disposed on the outer peripheral surface of the neck portion of the bulb and/or the deflecting coil assembly in the region between the emitting end of the electron guns and the center of deflection of the deflection coil assembly, thereby providing a magnetic field which acts to rotate at least two electron beams around the tube axis when looked from the front side of the phosphor screen.

According to one aspect of the present invention, there is provided, in a color picture tube including a cathode-ray bulb having a panel portion, a funnel portion and a neck portion, electron guns housed within the neck portion of the bulb for emitting three electron beams toward the inner surface of the panel portion of the bulb, and a deflection coil assembly disposed on the outer peripheral surface of the funnel portion of the bulb for deflecting the electron beams, a device for correcting color misalignment comprising magnet means disposed on the outer peripheral surface of the cathode-ray bulb in the region defined between the emitting end of the electron guns and the center of deflection of the deflection coil assembly for providing a magnetic field acting to cause rotating movement of the electron beams around the axis of the neck portion of the bulb in a predetermined direction.

Figure 4B:
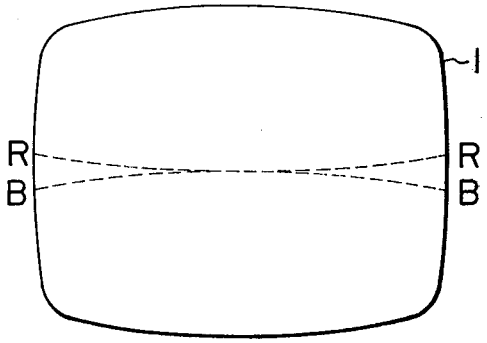
FIG. 4b PRIOR ART
Figure 5B:
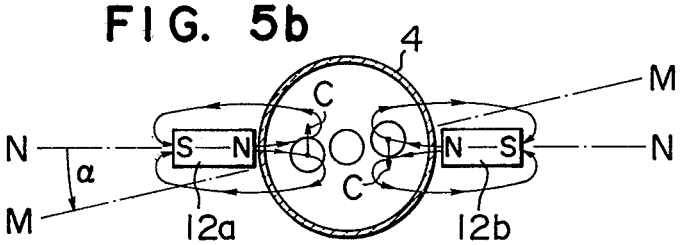
Figure 5A:
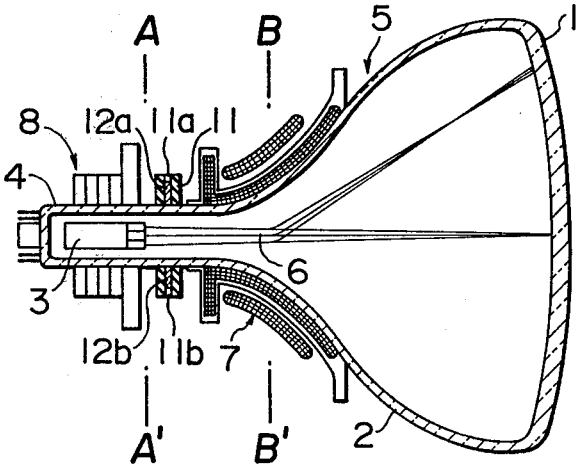
Figure 5C:
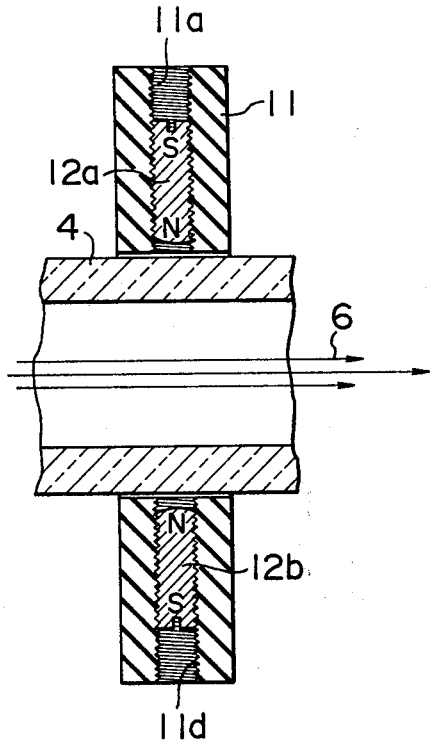
Figure 6:
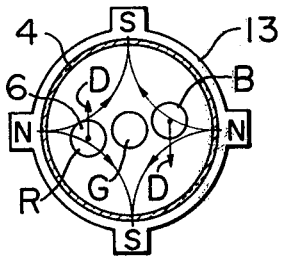
Figure 7:
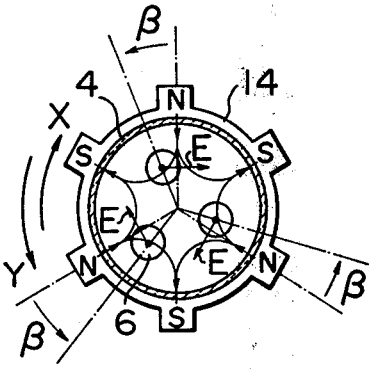

The above and other objects, features and advantages of the present invention will be more clear from the following detailed description with reference to the accompanying drawings, in which:

FIG. 1 is a schematic sectional view of part of a prior art color picture tube;

FIGS. 2*a* and 2*b* are a schematic front elevational view to show the electron gun arrangement when looking toward the electron guns from the side of the phosphor screen, and a schematic front elevational view to illustrate a dynamic convergence pattern when looking toward the phosphor screen from the side of the electron guns, respectively, when the prior art color picture tube is of the delta type;

FIGS. 3*a* and 3*b* are view similar to FIGS. 2*a* and 2*b* respectively to show the electron gun arrangement and dynamic convergence pattern when the prior art color picture tube is of the in-line type;

FIGS. 4*a* and 4*b* are a schematic front elevational view to show the electron gun arrangement in the prior art color picture tube of the in-line type when a mounting error occurs during mounting the electron guns, and a schematic front elevational view to illustrate an arc-shaped convergence error resulting from the mounting error, respectively;

FIGS. 5*a* to 5*c* show a first embodiment of the color picture tube according to the present invention, in which FIG. 5*a* is a schematic sectional view of part of the color picture tube, FIG. 5*b* illustrates schematically the arrangement and operating principle of the color misalignment correction device, and FIG. 5*c* is an enlarged sectional view to show in detail the structure of the color misalignment correction device;

FIG. 6 is a schematic sectional view of a part of a second embodiment of the color misalignment correction device of the present invention; and FIG. 7 is a schematic sectional view of part of a third embodiment of the color misalignment correction device of the present invention.

Referring to FIG. 5*a* showing part of the color picture tube according to the present invention in schematic sectional view, the same reference numerals are used to designate the same or equivalent parts appearing in FIG. 1.

In FIG. 5*a*, a thick-walled cylindrical or disc-shaped supporting member 11 of non-magnetic material is fixedly mounted on the outer peripheral surface of the neck portion 4 of the bulb 5 in the zone ranging from the emitting end of the electron guns 3 to the center of deflection of the deflection coil assembly 7, that is, in the zone defined between the one-dot chain section lines A—A' and B—B' shown in FIG. 5*a*. As best shown in FIGS. 5*b* and 5*c*, a pair of aligned threaded holes 11*a* and 11*b* extend through the supporting member 11 from its outer periphery toward the central axis of the bulb 5 and are arranged to conform to the horizontal in-line arrangement of the electron guns 3 emitting the three electron beams 6. A pair of screw-like permanent magnet pieces 12*a* and 12*b* are prepared to be screwed into the threaded holes 11*a* and 11*b* of the supporting member 11 respectively. These permanent magnet pieces 12*a* and 12*b* have an N-pole and an S-pole and are formed with threads on their columnar surface to conform to the pitch of the threads of the threaded holes 11*a* and 11*b*. The permanent magnet pieces 12*a* and 12*b* are screwed into the respective threaded holes 11*a* and 11*b*, and the position thereof is suitably adjusted so that the tip of the N-pole is brought in close proximity to the outer peripheral surface of the neck portion 4 of the bulb 5. The supporting member 11 is mounted on the outer peripheral surface of the neck portion 4 of the bulb 5 in such a relationship that the line connecting the N-pole and the S-pole of the magnet piece 12*a* aligns with the corresponding line in the magnet piece 12*b*, and the magnet pieces 12*a* and 12*b* oppose each other at the poles of the same polarity on both sides of the axis of the neck portion 4 of the bulb 5.

The magnetic field produced by these magnet pieces 12*a* and 12*b* acts to impart to the three electron beams 6 a force which tends to rotate the electron beams 6 around the axis of the neck portion 4 of the bulb 5 in a direction (as shown by the arrow C in FIG. 5*b*) opposite to the direction of the "twist error". Therefore, the two electron beams corresponding to red and blue running adjacent the inner wall of the neck portion 4 of the bulb 5 are freed from the "twist error" to run correctly in the horizontal direction. Consequently, the "twist error" of the three electron beams 6 is eliminated so that the three electron beams 6 can be properly concentrated to completely correct the arc-shaped convergence error of the red and green electron beams in the peripheral area of the phosphor screen.

In the aforementioned first embodiment of the present invention, the supporting member 11 is mounted on the outer peripheral surface of the neck portion 4 of the bulb 5, and the magnet pieces 12*a* and 12*b* are inserted into this supporting member 11. It is apparent, however, that the effect of the present invention is entirely the same when the magnetic pieces 12*a* and 12*b* are disposed on a suitable portion of the deflection coil assembly 7 in place of the arrangement above described. This alternative arrangement is advantageous in that the supporting member 11 is unnecessary thereby capable of reducing the cost by that much. Further, a plurality of pairs of such color misalignment correcting magnet pieces may be disposed within the region A–B instead of the single pair. Furthermore, the magnet pieces 12*a* and 12*b* may be arranged to align on a line M—M in FIG. 5*b* although they are preferably arranged to align on the line N—N.

FIG. 6 is a schematic sectional view of part of a second embodiment of the color misalignment correction device of the present invention which is similarly applied to a color picture tube of the in-line type. Referring to FIG. 6, an annular magnet piece 13 is mounted on the outer peripheral surface of the neck portion 4 of the bulb 5 within the region A–B ranging from the emitting end of the electron guns 3 to the center of deflection of the deflection coil assembly 7 in the color picture tube. As shown in FIG. 6, the annular magnet piece 13 mounted on the outer peripheral surface of the neck portion 4 of the bulb 5 comprises four poles, that is, two N-poles and two S-poles magnetized in 90° spaced apart relation. The annular magnet piece 13 is disposed to be rotatable on the neck portion 4 of the bulb 5 so that the line connecting the N-poles can extend substantially along a horizontal line. Another magnet piece 13 of the same shape and magnetized pattern as the aforementioned magnet piece 13 may be mounted rotatably on the outer peripheral surface of the neck portion 4 of the bulb 5 in close proximity to the latter. This second magnet piece 13 is suitably rotated to suitably adjust the intensity of the magnetic field acting in the direction of from the N-pole to the S-pole thereby imparting to the electron beams 6 a force which tends to rotate these electron beams 6 around the axis of the neck portion 4 of the bulb 5 in a direction (as shown by the arrow D) opposite to the direction of the "twist error". Therefore, the red and blue electron beams 6 running adjacent the inner wall of the neck portion 4 of the bulb 5 are controlled to align exactly in the horizontal direction, with the result that the "twist error" is corrected to eliminate the arc-shaped convergence error.

FIG. 7 is a schematic sectional view of part of a third embodiment of the color misalignment correction device of the present invention, which illustrates an application of the device to a color picture tube of the delta type. The three electron guns 3 are shown displaced undesirably from the proper mounting position by an angle $\beta$. An annular magnet piece 14 having six magnetic poles, that is, three N-poles and three S-poles is mounted rotatably on the outer peripheral surface of the neck portion 4 of the bulb 5. As in the aforementioned second embodiment, another annular magnet piece 14 of similar pole arrangement may be suitably rotated in a direction as shown by the arrow X or Y to vary the intensity of the magnetic field acting in the direction of from the N-pole to the S-pole. A force tending to rotate the three electron beams 6 around the axis of the neck portion 4 of the bulb 5 is imparted to the three electron beams 6 in a direction (as shown by the arrow E) opposite to the direction of the "twist error", thereby correcting the running path of the electron beams 6 to achieve the effect similar to that above described.

The aforementioned embodiments have referred to a specific arrangement in which a pair of bar magnet pieces carried by a supporting member or annular magnet pieces are mounted on the outer peripheral surface of the neck portion of the bulb within the region A–B defined between the emitting ends of the electron guns and the center of deflection of the deflection coil assembly. A plurality of pairs of such color misalignment correcting magnet pieces may be provided within the region A–B.

The mounting position of the magnet pieces must be included within the region defined between the vertical line A—A′ extending through the emitting end of the electron guns 3 and the vertical line B—B′ extending through the center of deflection of the deflection coil assembly 7 as shown in FIG. 5*a*. The reason therefor will be described presently. The central electron beam among the three electron beams 6 will be slightly affected by the magnetic field shown in FIG. 5*b* or FIG. 6, or the three electron beams 6 will be subjected to, for example, a horizontal force in addition to the force tending to rotate them around the axis of the neck portion 4 of the bulb 5. It is therefore necessary to re-adjust the static convergence during mounting the device of the present invention in position. Thus, the dynamic convergence correcting magnet means must be disposed in the region which is nearer to the panel portion 1 of the bulb 5 than the static convergence correcting magnet assembly 8. Correction of the arc-shaped dynamic convergence error becomes impossible after the three electron beams 6 have been completely deflected by the deflection coil assembly 7. Therefore, the dynamic convergence correcting magnet means must be disposed in the region which is nearer to the electron guns 3 than the line B—B′ extending through the center of deflection of the deflection coil assembly 7, that is, the line extending approximately the center of the length of the deflecting magnetic field along the bulb axis.

It will be understood from the foregoing detailed description that the present invention provides, in a color picture tube including a cathode-ray bulb having a panel portion, a funnel portion, and a neck portion, electron guns housed within the neck portion of the bulb for emitting three electron beams toward the inner surface of the panel portion of the bulb, and a deflection coil assembly disposed on the outer peripheral surface of the funnel portion of the bulb for deflecting the electron beams, a device for correcting color misalignment comprising magnet beams disposed on the outer peripheral surface of the neck portion of the bulb and/or the deflection coil assembly in the region defined between the emitting end of the electron guns and the center of deflection of the deflection coil assembly for providing a magnetic field acting to cause slight rotation of the electron beams around the axis of the neck portion of the bulb. The device having such features is advantageous in that it is effective in very easily and reliably correcting an arc-shaped dynamic convergence error appearing on the phosphor screen due to a mounting error of the electron guns and an assembling error of the deflection coil assembly. Thus, the precision of dynamic convergence can be remarkably improved. The device of the present invention is further advantageous in that productivity can be improved in the step of mounting the deflection coil assembly on the funnel portion of the bulb and also in the step of sealing the electron guns within the neck portion of the bulb, and that the yield rate of color picture tubes can be greatly improved.

What we claim is:

1. In a color picture tube including a cathode-ray bulb having a panel portion, a funnel portion and a neck portion, electron guns housed within the neck portion of said bulb for emitting three electron beams toward the inner surface of the panel portion of said bulb, and a deflection coil assembly disposed on the outer peripheral surface of the funnel portion of said bulb for deflecting said electron beams, a device for correcting color misalignment comprising permanent magnet means disposed on the outer peripheral surface of said cathode-ray bulb in the region defined between the emitting end of said electron guns and the center of deflection of said deflection coil assembly for providing a non-varying magnetic field acting to cause rotating movement of said electron beams around the axis of the neck portion of said bulb in a predetermined direction to reduce arc-shaped convergence errors at the peripheral areas of the panel.

2. A color misalignment correction device as claimed in claim 1, further comprising means for supporting said permanent magnet means, said supporting means supporting at least two permanent magnet pieces in such a relationship that the magnetic poles of the same polarity are disposed substantially opposite to each other relative to the axis of the neck portion of said bulb.

3. A color misalignement correction device as claimed in claim 2, wherein said supporting means comprises means for adjusting the magnetic force imparted by said magnet means to said electron beams and supports said magnet pieces on a line orthogonal to the axis of the neck portion of said bulb, and said adjusting means acts to vary the relative distances between the outer peripheral surface of said bulb and said permanent magnet pieces.

4. A color misalignment correction device as claimed in claim 1, wherein said permanent magnet means comprises at least one annular member of magnetic material having an opening adapted to fit on the outer periphery of said bulb, said annular member having at least two permanent magnets formed by magnetization.

5. A color misalignment correction device as claimed in claim 4, wherein said two permanent magnets are formed so that the magnetic poles of the same polarity are disposed substantially opposite to each other relative to the axis of the neck portion of said bulb, and said annular member is rotatable on the outer peripheral surface of said bulb around said bulb axis so as to vary the magnetic force imparted to said electron beams by said permanent magnets.

6. A color misalignment correction device as claimed in claim 1, wherein said permanent magnet means comprises at least one annular member of magnetic material having an opening adapted to fit on the outer periphery of said bulb, said annular member having at least three permanent magnets formed by magnetization.

7. A color misalignment correction device as claimed in claim 6, wherein said three permanent magnets are formed so that the magnetic poles of the same polarity are arranged in a delta pattern conforming to the delta arrangement of said electron guns, and said annular member is rotatable on the outer peripheral surface of said bulb around said bulb axis so as to vary the magnetic force imparted to said electron beams by said permanent magnets.

* * * * *